US005490378A

United States Patent [19]

Berger et al.

[11] Patent Number: 5,490,378

[45] Date of Patent: Feb. 13, 1996

[54] GAS TURBINE COMBUSTOR

[75] Inventors: Johann Berger, Moosburg; Burkhard Simon, Rohrmoos, both of Germany

[73] Assignee: MTU Motoren- und Turbinen-Union Muenchen GmbH, Munich, Germany

[21] Appl. No.: 122,493

[22] PCT Filed: Feb. 27, 1992

[86] PCT No.: PCT/EP92/00425

§ 371 Date: Dec. 7, 1993

§ 102(e) Date: Dec. 7, 1993

[87] PCT Pub. No.: WO92/17736

PCT Pub. Date: Oct. 15, 1992

[30] Foreign Application Priority Data

Mar. 30, 1991 [DE] Germany ..... 41 10 507.9

[51] Int. Cl.[6] ..... F23R 3/14

[52] U.S. Cl. ..... 60/39.23; 60/748

[58] Field of Search ..... 60/748, 39.23, 60/39.29, 737, 740; 239/402.5, 403, 405

[56] References Cited

U.S. PATENT DOCUMENTS

| | | | |
|---|---|---|---|
| 2,655,787 | 10/1953 | Brown | 60/39.23 |
| 3,899,881 | 8/1975 | Arvin et al. | 60/737 |
| 3,930,368 | 1/1976 | Anderson et al. | 60/39.23 |
| 3,930,369 | 1/1976 | Verdouw | 60/39.23 |
| 4,263,780 | 4/1981 | Stettler | 60/748 |
| 4,534,166 | 8/1985 | Kelm et al. | 239/402.5 |
| 4,726,182 | 2/1988 | Barbier et al. | 60/748 |
| 4,754,600 | 7/1988 | Barbier et al. | 60/748 |
| 4,825,641 | 5/1989 | Mandet et al. | 60/39.23 |
| 4,842,197 | 6/1989 | Simon et al. | 239/403 |
| 5,357,743 | 10/1994 | Zarzalis et al. | 60/39.23 |
| 5,373,693 | 12/1994 | Zarzalis et al. | 60/39.23 |

FOREIGN PATENT DOCUMENTS

| | | |
|---|---|---|
| 0182687 | 5/1986 | European Pat. Off. . |
| 0251895 | 1/1988 | European Pat. Off. . |
| 417224 | 1/1967 | Switzerland . |
| 2005006 | 4/1979 | United Kingdom . |
| 2198521 | 6/1988 | United Kingdom . |

*Primary Examiner*—Timothy S. Thorpe
*Attorney, Agent, or Firm*—Evenson, McKeown, Edwards & Lenahan

[57] ABSTRACT

A gas turbine combustor has at least one fuel nozzle located at a head end of the combustor. At least one swirl device is adjustable as a function of a load for supplying combustion air. The swirl device includes radial/tangential apertures formed between profiles of an annular body arranged coaxially with respect to the nozzle. The apertures are uniformly distributed around the circumference of the annular body and have aperture cross-sections that are constant along their entire length. The swirl device further includes a sleeve having fingers which extend inwardly to engage the apertures. The sleeve is adjustable with respect to the annular body. The fingers are axially displaceable within the apertures via the sleeve. The fingers are each arranged parallel to aperture walls spaced from the fingers to bound a maximal adjusting path of the fingers to form duct walls of the apertures. The fingers are coordinated with respect to their width and length with the apertures such that in an intermediate adjusted position of the fingers, each finger coordinates with its respective aperture wall to provide a flow cross-section that is constant along the aperture length.

21 Claims, 5 Drawing Sheets

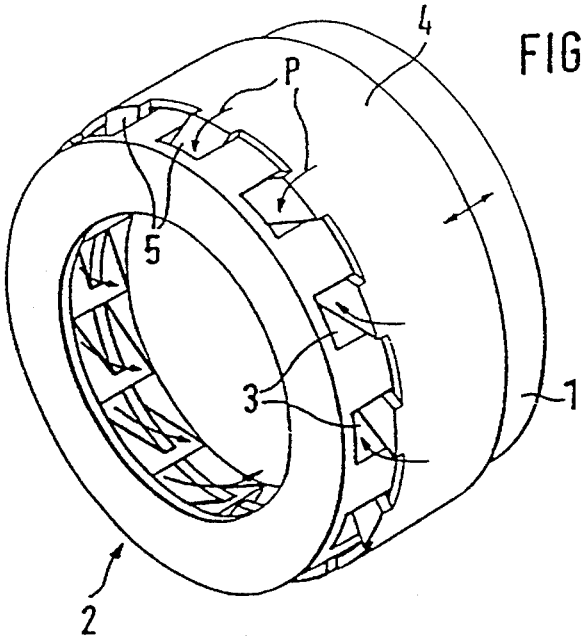
FIG. 1
FIG. 3
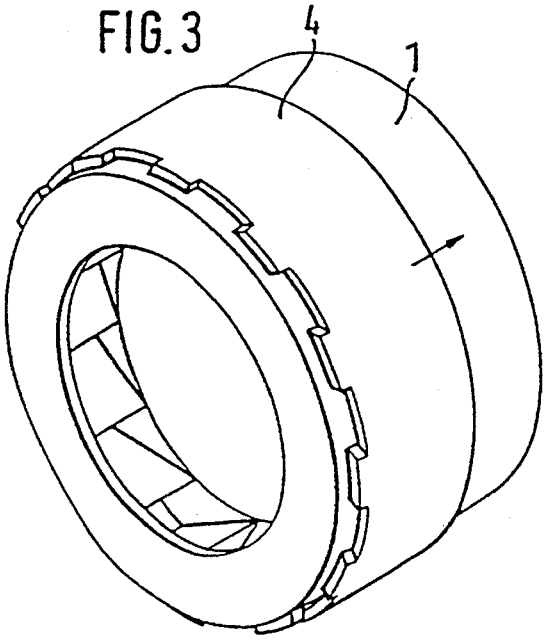
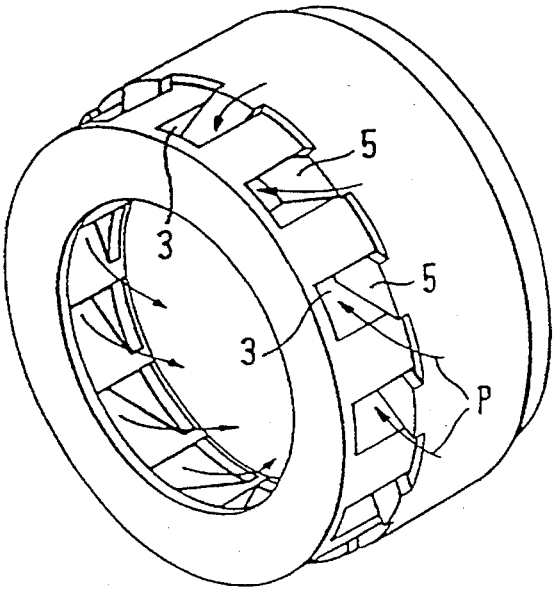
FIG. 2

FIG. 7
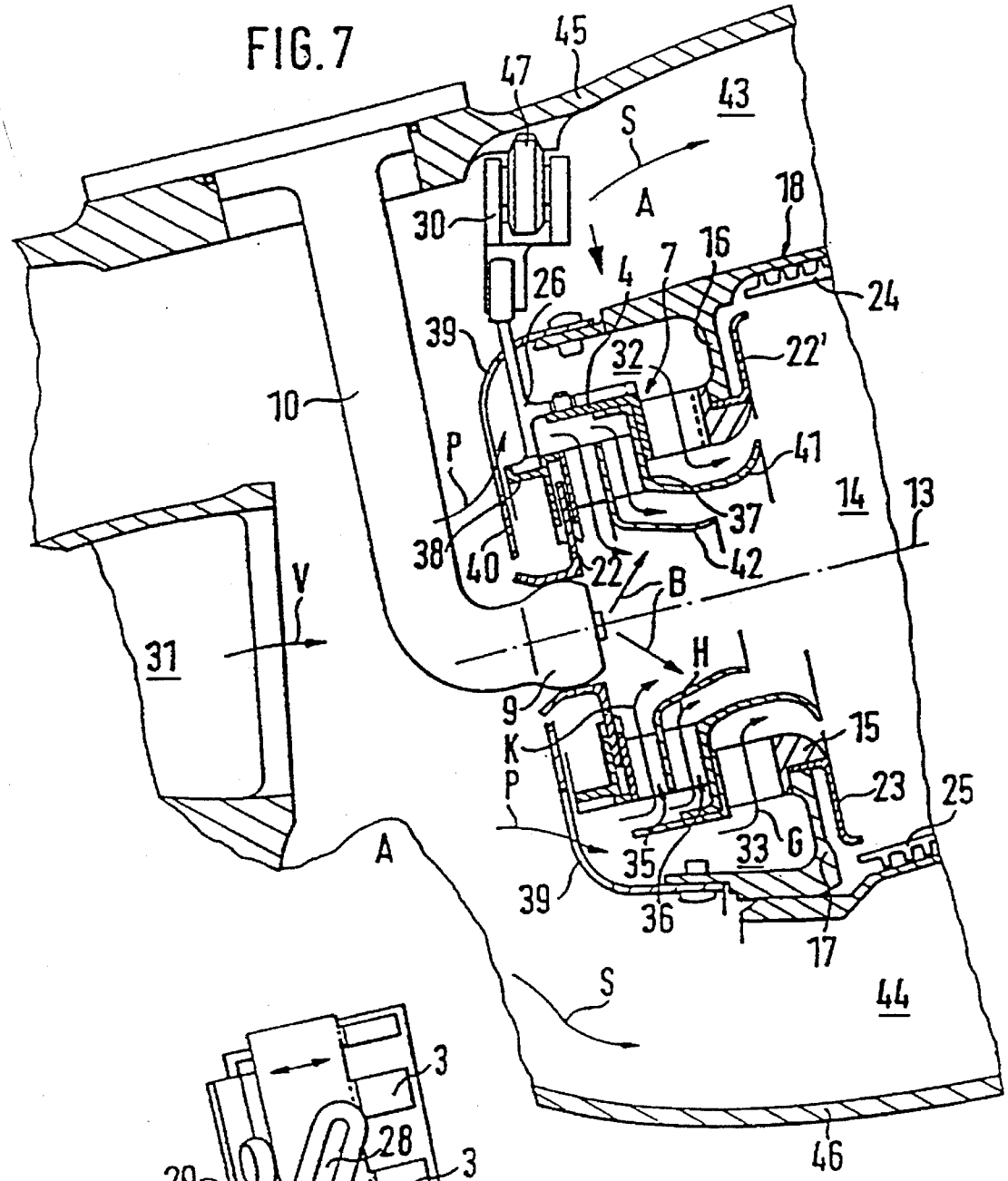
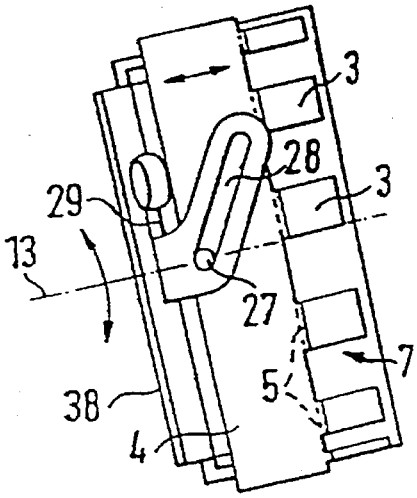
FIG. 8

GAS TURBINE COMBUSTOR

BACKGROUND AND SUMMARY OF THE INVENTION

The invention relates to a combustor, and, more particularly, to a gas turbine combustor having, on a head end, particularly of an annular combustion chamber, at least one fuel nozzle and at least one swirl device which can be adjusted as a function of the load for the supply of combustion air. The swirl device has, between profiles of a nozzle-coaxial annular body, radial/tangential apertures which are distributed uniformly along the circumference, and have a cross-section that is constant along its overall length, and into which inwardly extending fingers of a sleeve which can be adjusted with respect to the annular body engage.

In the case of modern combustors and combustion chamber designs for gas turbine engines, a combustion is endeavored that is as low as possible in pollutants, particularly in the primary zone of the combustion chamber. The important pollutants are: CO (carbon monoxide), $NO_x$ (nitrogen monoxide), $C_xH_y$ (non-burned hydrocarbons) as well as C (carbon). It was found that a considerable reduction of all concerned pollutant emissions is achieved at a comparatively low combustion temperature of <1,900° K. in combination with a comparatively high proportion of air compared to the supplied fuel.

In addition, relatively low pollutant emissions require, among other things, a uniform processing of the fuel-air mixture to be supplied to the primary zone as well as a good degree of burn-out. This is particularly true in combination with combustors which operate by means of air support as "low-pressure systems" with a high fuel atomization quality and a partially wall-side (fuel film on sleeve) and aerodynamic fuel evaporation. In this case, local undesirable fuel enrichment which may cause the forming of soot should be avoided, among others.

A combustor of this type for combustion chambers of gas turbine engines is known, for example, from German Patent Document DE-PS 24 42 895. However, without exception, the known combustor has stationary, and therefore non-controllable swirl devices for the fed combustion air. No possibility is therefore indicated in this case to master different operating conditions, such as starting, full load, idling, cruising (stationary), in a manner that is as low in pollutants as possible with respect to the corresponding required variable fuel-air flow rates.

From German Patent Document DE-OS 24 60 740, a two-zone combustion chamber concept is known with a high-temperature first combustion zone which is rich in fuel and has an approximately stoichiometric combustion and with a low-temperature second or main combustion zone which is connected axially behind the first combustion zone, is low in fuel and is therefore as low as possible in pollutants.

In the known case, there are fuel injection nozzles which can only be controlled separately for the respective combustion zones. There is no primary air feeding that can be controlled in consideration of variable operating conditions with a view to a low-pollutant "cold" combustion. Furthermore, in the known case, no swirl devices are provided by which the primary air to be fed is provided with rotational swirls and the fuel-air mixture can be processed in a homogeneous manner and an aerodynamically stable reaction zone can be built up for the combustion. In addition, such a known two-zone combustion concept is high in constructional expenditures and relatively expensive while also requiring a relatively pronounced chamber volume and a large combustion chamber length.

Furthermore, in the interest of a low pollutant combustion, combustion chamber concepts which provide a "variable chamber geometry" in order to supply combustion air and possibly mixed air by way of holes of rows of holes are high in constructional expenditures, technically complex, susceptible to disturbances and expensive. The holes can be controlled in their cross-sections in that tube sections of the flame tube jacket of the combustion chamber can be displaced relative to one another in the axial or circumferential direction.

From European Patent Document EP-PS 0251895, an annular combustion chamber of a gas turbine engine is known which has, on the air-approach-side head end, several combustors distributed along the circumference. For a combustion that is low in pollutants, an "external" swirl device is assigned to each combustor. The swirl device can be regulated or blocked off with respect to the supply of a portion of the combustion air. A nozzle-central, axially fixed whirling device may be assigned to the "external" swirl device. Between radial wall portions of a nozzle-coaxial central body, the "external" swirl device is constructed with a radial inflow and with obliquely set apertures which are uniformly arranged along the circumference. The adjusting takes place by a screen which can be rotated on the outside on a central body in the circumferential direction and which has fingers on openings distributed along the circumference. The fingers, according to their length, project partly into the apertures and in intermediate positions of the screen. Each has an angular position which deviates from the apertures. In the intermediate positions of the screen which are decisive for the adjusting, in the known case, a pre-throttling of the air flow takes place in conjunction with an aerodynamic influencing which interferes with the natural given geometry of the apertures. In other words, in the manner of a separating diffusor flow, the respective circumferential component of the flow at the respective outlet of an aperture is clearly reduced, whereby the required swirl generating is considerably impaired. However, this is a significant disadvantage for a uniform turbulence development required during the whole operating condition and a resulting uniform combustion which is stable and low in pollutants.

There is therefore needed a combustor of the initially mentioned type in the case of which at least one swirl device permits the air flow rate operationally required for a combustion which is homogeneous and low in pollutants while a uniformly pronounced rotational whirl is maintained.

According to the invention, this need is met by a gas turbine combustor having, on a head end, particularly of an annular combustion chamber, at least one fuel nozzle and at least one swirl device which can be adjusted as a function of the load for the supply of combustion air. The swirl device has, between profiles of a nozzle-coaxial annular body, radial/tangential apertures which are distributed uniformly along the circumference, and have a cross-section that is constant along its overall length, and into which inwardly extending fingers of a sleeve which can be adjusted with respect to the annular body engage. The fingers engage by way of the sleeve in an axially displaceable manner in the apertures. The fingers are each arranged in parallel to axially spaced walls of the apertures which bound the maximal adjusting path and form duct walls of the apertures which move along by way of the sleeve. With respect to their width and length, the fingers are coordinated with the apertures in such a manner that, in intermediate positions, each finger adjusts with respect to the respective one wall a flow cross-section which is constant along the whole aperture length.

In the case of the invention, it is essential and important that, with respect to the swirl device, in all intermediate positions of the axially slidable sleeve, the existing geometry of the apertures is maintained with respect to the radial tangential flow. The fingers virtually form in each case a lateral wall of an aperture which is moved along with the sleeve in the axial direction and which is designed to be coordinated with respect to the circumferential width, height and length with the respective duct height and length. Preferably, the apertures may therefore in each case form a rectangular, square or rhombic duct cross-section, in which case the actual flow is in each case formed between the one movable wall and the locally exposed stationary wall sections of the apertures. Furthermore, according to the invention, the apertures may also be constructed or defined as ducts or slots. Thus, by way of the indicated characteristics, the swirl flow and therefore the desired rotational whirl geometry which shares in the responsibility of an optimal processing of the fuel-air mixture is not impaired in the different intermediate positions.

By means of the swirl device, the whole or a significant portion of the primary air can be supplied which is required for a combustion that is low in pollutants. In the case of only one controllable swirl body, the flow ducts or apertures would therefore have to have sufficiently large dimensions.

In an advantageous further development, the invention permits the combination of at least one controllable or adjustable swirl device with a stationary swirl device which makes available a constant air supply during the whole operating condition. The fuel supply is varied depending on the load condition, in which case an air supply is "superimposed" on the variable operating conditions which, while being adapted to the respective operating conditions, meets the air requirement with respect to a combustion that is low in pollutants. The latter air requirement may be adjusted, for example, as a function of an operationally increasing combustion temperature and/or pressure in the combustion chamber.

The invention includes the possibility of burning, for example, stoichiometrically, in certain engine conditions—as well as dependent upon the design and use spectrum of the engine—thus during the igniting and the start of the operation as well as, possibly, during an extreme full load, and burning—predominantly in the cruising operation—with a large amount of air and therefore in a manner that is low in pollutants.

The concerned swirl devices may generate approximately in the same direction or in mutually opposite directions rotational or mixed-air whirls which rotate with respect to the combustor axis or nozzle axis.

Other objects, advantages and novel features of the present invention will become apparent from the following detailed description of the invention when considered in conjunction with the accompanying drawings.

BRIEF DESCRIPTION OF THE DRAWINGS

FIG. 1 is a perspective view of an adjustable swirl device which is part of the combustor, in an intermediate position, while illustrating the radial/tangential air flow though the apertures, partially on the outer side and the inner side, relative to a downstream annular body of a central body, with a corresponding sleeve position;

FIG. 2 is a perspective view of the swirl device according to FIG. 1, however illustrating a completely opened-up end position of the apertures;

FIG. 3 is a perspective view of the swirl device according to FIGS. 1 and 2, however illustrating a completely closed end position of the apertures;

FIG. 7 is an axial sectional view of a combustor in a second embodiment in the combination of two stationary swirl devices with a third adjustable swirl device connected behind them, in which, in addition to the head end according to FIG. 6, the exterior housing and axial diffusor sections are shown, partially broken off, as well as particularly details of an actuating device of the adjustable swirl device are illustrated;

FIG. 8 is a view of the combustor in the viewing direction A of FIG. 7, with a further clarification of the actuating device.

DETAILED DESCRIPTION OF THE DRAWINGS

Figure 4:
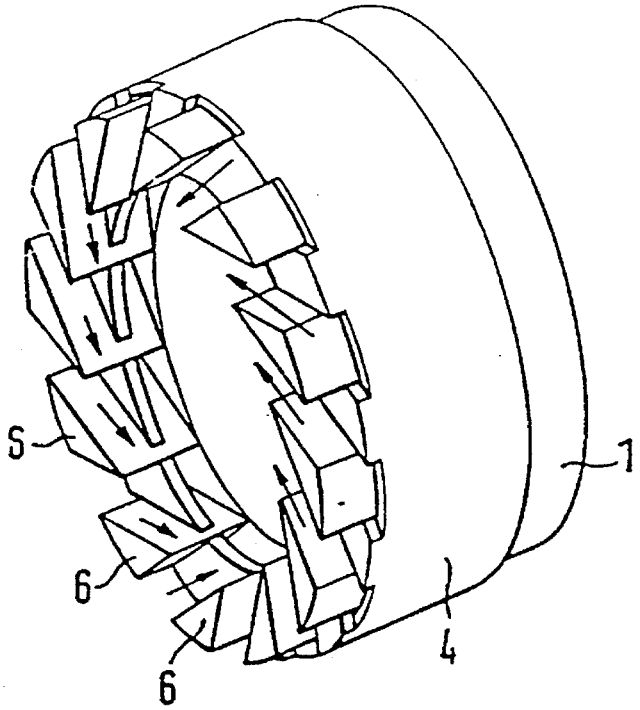
FIG. 4 is a perspective view of the swirl device according to FIGS. 1 to 3, wherein, while the front-side end wall of the annular body is omitted, the profile bodies are shown which are arranged to be uniformly distributed along the circumference and which form the apertures, in conjunction with an intermediate position of the sleeve together with the fingers.

Relative to a suitable arrangement in the case of a combustor for the combustion chamber of a gas turbine engine, FIGS. 1 to 5 illustrate an adjustable swirl device. With respect to the present application, it has arranged coaxially with respect to the axis of the combustor or the fuel nozzle, on the downstream end of a central body 1, an annular body 2 with apertures 3 which are distributed uniformly along the circumference. An axially slidable sleeve 4 is disposed on the central body 1. The sleeve 4, on the downstream end, engages in the apertures 3 by means of fingers 5 which are perpendicularly angled with respect to the combustor axis. In this case, the fingers 5 extend in parallel to the axially spaced straight walls of the apertures 3. These apertures 3 have a respective continuously square, particularly rectangular cross-section. In other words, the fingers 5 represent walls in the apertures 3 which can be moved axially with the sleeve 4 in order to control the flow rate of primary air to be radially fed (arrow P) (intermediate position according to FIGS. 1, 4 or 5), block it completely (FIG. 3), or expose it completely (FIG. 2).

Figure 5:
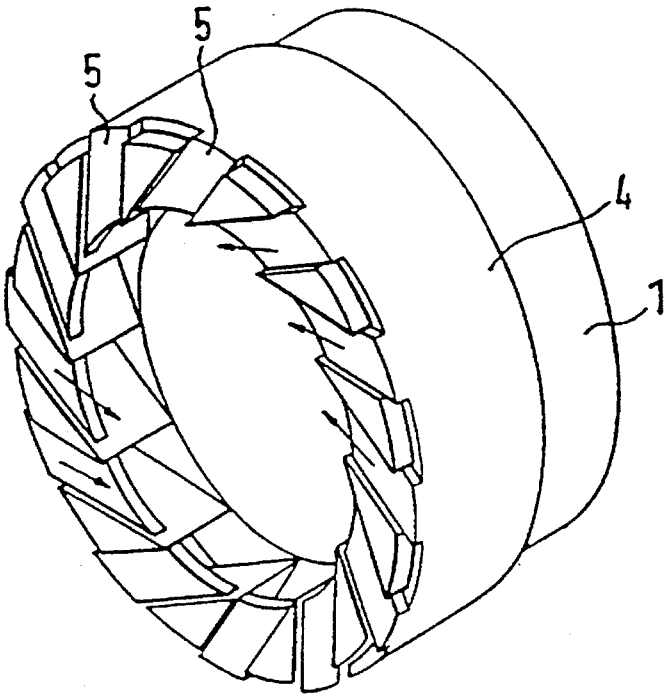
FIG. 5 is a perspective view of the swirl device, omitting the from wall of the annular body according to FIG. 4, but while illustrating a position of the sleeve together with the fingers in which the apertures are almost closed.

As indicated particularly in FIG. 5, i.e., the intermediate position of the fingers 5 when the apertures 3 are almost closed, the fingers 5 extend along the respective overall length of an aperture 3. The apertures 3 may also be called "slots". Furthermore, they may also have a square or, for example, rhombic cross-section of respective equal shape and size along the respective overall length. The respective radially/tangentially set apertures 3 may—according to FIG. 4—be constructed on the central body 1 between end portions 6 which are spaced uniformly in the circumferential direction and have wedge-shaped profiles. The end portions 6 may also be described or constructed as blade profiles; this would be similar to the type known from wedge-shaped diffusor blade profiles, however, without aiming at the construction of a diffusor. Furthermore, the end portions may also be described to be "wedge-shaped, tooth-like". It is shown, for example, in FIGS. 1, 2 and, that the sleeve 4 reaches in each case by means of two fingers which are spaced or adjacent in the circumferential direction, around a wedge-shaped end portion or profile. At respective points between the fingers 5, the sleeve 4 is therefore also disposed in an axially slidable manner on the outer circumferential surfaces of the end portions or profiles. These outer circumferential surfaces are therefore components of the outer cylindrical circumferential contour of the central body 1 interrupted by the apertures 3. This outer "resting" of the sleeve 4 is important in order to ensure a blocking of the apertures 3 that is as perfect as possible (FIG. 3).

According to the invention, it would also be possible to mount the fingers 5 or "side walls" of the apertures 3 or ducts as control bodies, which can be axially displaced together with the sleeve 4, on the inside on the sleeve, for example, by means of a welded connection. This may be advantageous when the goal consists of controlling several adjustable swirl devices simultaneously together with a sleeve; specifically, similar or comparable to an arrangement according to FIG. 9 which will be described in the following.

In the embodiment of the controllable swirl device according to FIGS. 1 to 5, the corresponding fingers 5 or "control bodies" are—with respect to the arrangement of a combustor of a combustion chamber—radially angled or bent away from the downstream outer front end of the sleeve 4. Despite the variable change of the air flow rate from the closed end position (FIG. 3) by way of intermediate positions, such as FIG. 1, to the complete exposure (FIG. 2) of the apertures, the construction according to FIGS. 1 to 5 permits an unchanged generating of the swirl and therefore a rotational whirl formation.

In an outlet-side wall shield, coaxially to a central fuel nozzle, the indicated swirl device may, under certain circumstances, be used for the sole control, which can be varied according to the quantity, for all the primary air or for the predominant amount of primary to be fed. Together with the adjustable swirl device, remaining primary air may, if necessary, be supplied locally by way of special openings in the flame tube, specifically by way of the outer secondary air duct, between the outer housing of the combustion chamber and the flame tube.

Figure 6:
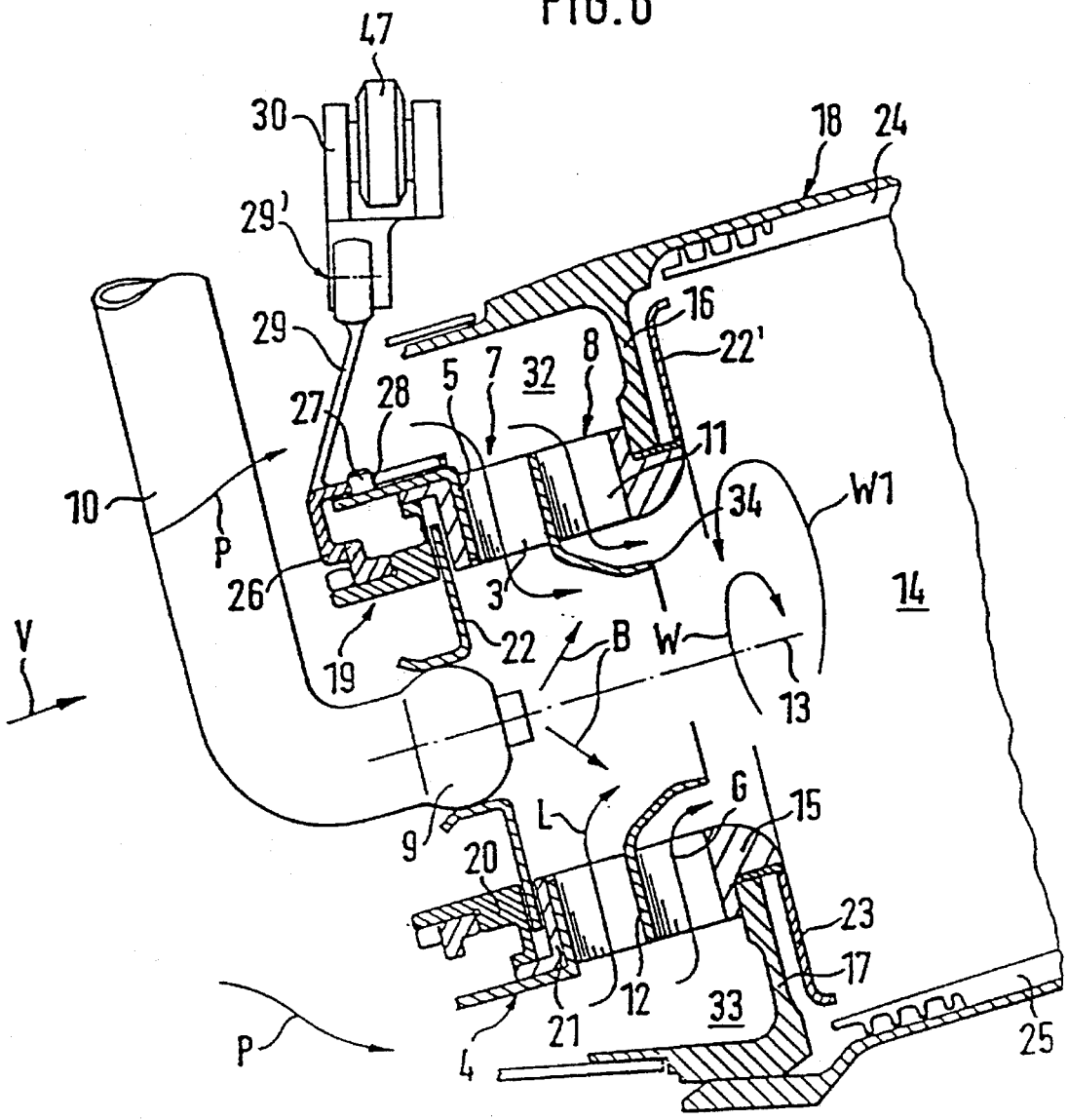
FIG. 6 is an axial sectional view of the combustor in a first embodiment on the upstream head end of the combustion chamber, together with flame tube and housing parts which are illustrated in a partially broken-off manner, the first combustor construction consisting of the combination of one adjustable and one stationary swirl device with an assignment to a central fuel nozzle.

FIG. 6 illustrates an advantageous combustor variant in the combination of a swirl device 7 according to FIGS. 1 to 5, which can be adjusted with respect to the flow rate of a partially radially fed primary air, and a stationary swirl device 8 which is arranged axially directly behind it. A fuel injection nozzle arranged centrally on the combustor has the reference number 9 and is connected to a fuel pipe 10 which is bent radially upward. The stationary swirl device 8 also has radial/tangential apertures 11 but for the flow rate of a primary air proportion which remains constant during the whole operating condition. A radial shielding wall axially separates the apertures 3, 11 from one another and continues in a radially/axially bent manner as a sleeve (Venturi pipe), which is open downstream coaxially to the nozzle axis or to the axis 13 of the combustor, in the direction of the primary zone 14. By means of an end portion 15 which is rounded off in the direction of the flow in a diverging manner, the swirl devices 7, 8 are fixed on the rearward end to the rear wall of the wall portions 16, 17 forming the flame tube 18. The apertures 3, 11 may be set radially/tangentially in the same direction or in mutually opposite directions in order to provide the respective emerging air flow (arrows L, G) with rotational whirls W, W1 rotating in the same direction or in mutually opposite directions. The central body 19 of the combustor, on which the sleeve 4 is disposed in an axially displaceable manner, is constructed in several parts in the present case. It consists of ring-type or sleeve-type components 20, 21 which are flanged to one another and between which a radial shielding wall 22 is held together with the fuel nozzle 9.

The above-mentioned rounded-off end portion 15 is widened by means of deflection sheets 22, 23, which thermally shield the sections 16, 17 of the rear wall, radially in the direction to the outside in an aerodynamically favorable manner to the full primary zone cross-section. In this manner, by way of the end portion 15, an almost separation-free air distribution is achieved also to the radially outer part of the primary zone. Reference numbers 24 and 25 indicate thermally insulating shielding walls or wall parts in the interior on the flame tube 18.

Figure 9:
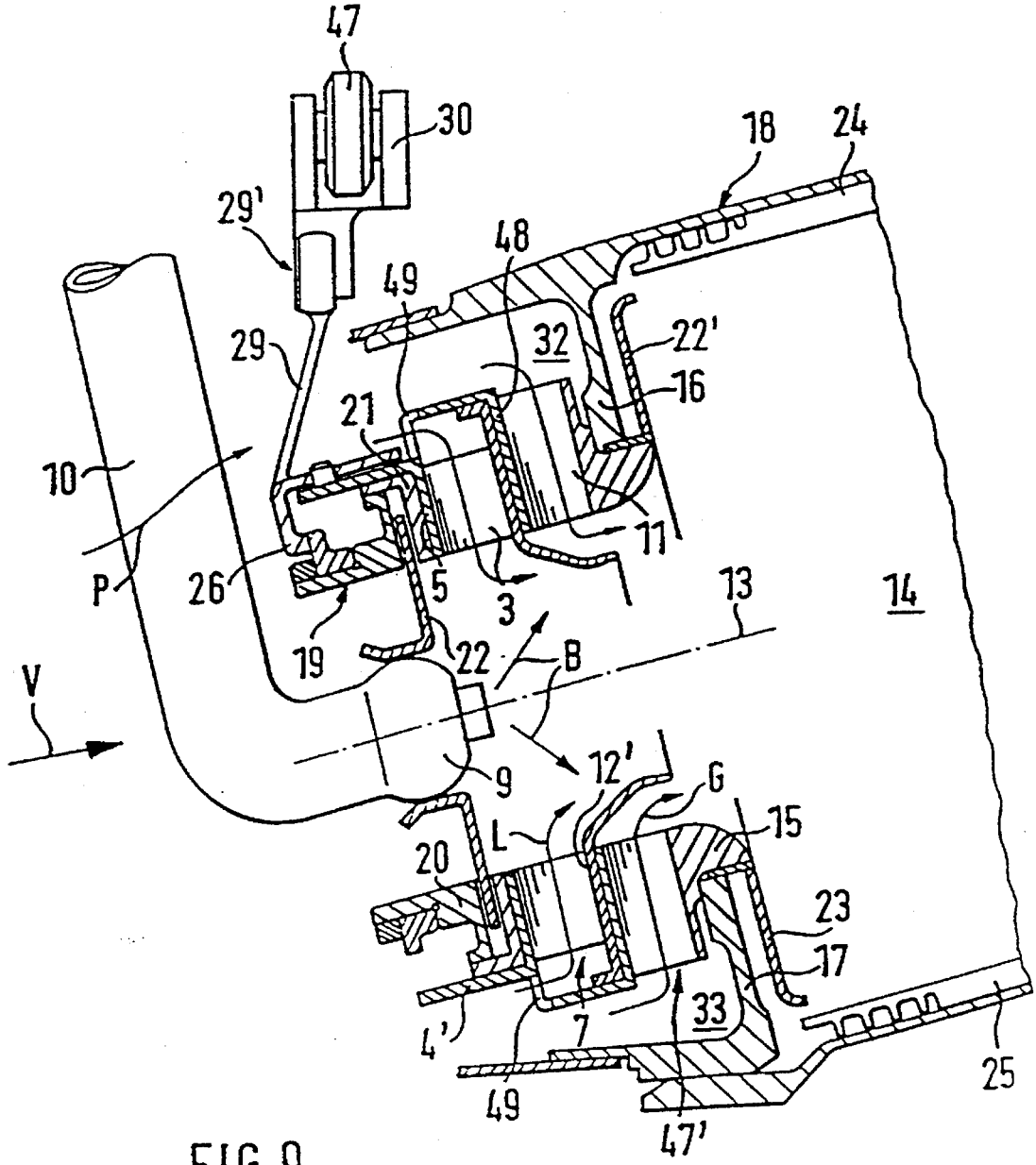
FIG. 9 is an axial sectional view of a combustor in a third embodiment, wherein the combustor, in addition to the central fuel nozzle on the upstream head end of the combustion chamber, has two adjustable swirl devices in addition to the axially slidable sleeve which are jointly responsible in this respect, as well as with details of the actuating devices used for this purpose.

As indicated in FIG. 6 and shown even better in FIGS. 7 and 9 with an analogous function, details of the actuating system for the axial sleeve adjustment are provided. For this purpose, in FIG. 6, a ring component 26 on the central body 19 reaches over the sleeve 4, in which case the sleeve 4 engages by means of a pin 27 in a slot 28 of the ring component which extends obliquely with respect to the axis of the combustor. A circumferential rotation of the ring component 26 on the central body 19 causes an axial adjustment of the sleeve 4. An arm 29, which projects radially away from the ring component 26, is applied in a pivotable manner by way of hinge point 29' to an adjusting ring 30 which is guided so that it can be adjusted in the circumferential direction on the outer housing 45 (FIG. 7) and which can be exposed to an adjusting movement which is initiated, for example, by a motor.

A portion of the compressor air fed in the direction of the arrow V by way of a diffusor 31 (FIG. 7) is fed as primary air P by way of head-side chambers 32, 33 radially to the swirl devices 7, 8 (FIG. 6). The arrows B symbolize the fuel (spray cone) injected from the fuel nozzle 9. Proportions of the fed fuel B may flow along downstream on the interior wall of the sleeve-type portion of the shielding wall 12 in a manner of a film (whirl film) or may possibly evaporate there and be retained on the air side (L, G). In this case, the swirl devices generate mutually opposite rotational whirls W, W1, for example, downstream of the combustor in the primary zone 14. By means of the relatively large shearing forces which are generated when the two oppositely directed rotational whirls W, W1 flow together, fuel which arrives on the circumferential or breakaway edge 34 of the sleeve portion of the wall 12 or which flows away from there, can be atomized in a pronounced manner.

While the same reference numbers are used for essentially identical components, FIG. 7 represents a combustor construction in which the controllable swirl device 7 is arranged behind first and second swirl devices 35 and 36 containing stationary radial/tangential apertures. By means of the adjustable swirl device 7, a significant proportion of the total primary air to be supplied as a function of the load can be supplied to the primary zone 14 in the interest of a combustion that is low in pollutants. Arrows G and H, K symbolically in each case represent the respective through-flow or flow-off direction of the corresponding primary air proportions—viewed from the right to the left. By means of primary air proportions fed under a swirl according to G,H,K, rotational whirls are generated which decrease—from the outside to the inside—in their diameter and are, for example, directed against one another. The fuel B fed by way of the fuel nozzle 9 is integrated into the rotational whirls in a manner that is very finely atomized or like fog and is homogenous.

According to FIG. 7, the stationary swirl device which is first—in the direction of the flow—is assigned closest to the fuel nozzle 9. An axially radially bent shielding wall 37 between the swirl devices 7, 36 operates as a support of the axially displaceable sleeve 4. The central body of the combustor, which is arranged coaxially with respect to the axis 13 of the combustor, encloses—viewed from the left to the right—a sleeve-type component 38, the nozzle-side radial shielding wall 22, the swirl devices 35, 36, 7, the shielding wall 37 as well as the end portion 15 rounded on the end side in a diverging manner. This end portion 15 is arranged downstream of the controllable swirl device 7 and is, at the same time, a device for the holding of the central body on the wall portions 16, 17 of the flame tube rear wall. An axial-flow diffusor for the air V taken out at the compressor end side and to be fed to the combustion chamber has the reference number 31. By way of openings 39 in an end hood 40 of the combustor, a portion of the fed air V flows as primary air P into the head end of the combustion chamber in order to be fed from there by way of the chambers 32, 33 to the swirl devices 35, 36, 37. The above-mentioned radial shielding wall 37 between the swirl devices 36, 7 is continued as a sleeve 41 which is open downstream and which is bent radially to the outside in the sense of a rounding of the end portion 15. A sleeve 42 which is closest to the fuel nozzle 9 is a component of a shielding wall between the swirl devices 35, 36.

A remaining portion of the compressor air V fed by way of the axial-flow diffusor 31 flows off as secondary air (arrows S) into annuli 43, 44, between outer housing walls 45, 46 and the flame tube 18 of the combustion chamber in order to, among other things, be supplied from there to the flame tube 18 as mixed air (dilution air) and as tertiary air (rendering the temperature profile uniform and reducing the temperature at the combustion chamber outlet).

On the sleeve-type component 38 of the central body of the combustor, the ring component 26 is guided so that it can be rotated in the circumferential direction by means of the oblique guide slot 28 (FIG. 8) into which the pin 27 projects which is connected with the axially displaceable sleeve 4. Positions 29, 29' and 30—lever arm hinge point, adjusting ring—of the adjusting system are virtually identical with those according to FIG. 6. FIG. 7 indicates that the adjusting ring 30 is by means of rollers 47 disposed on the housing 45 so that it can be rotated in the circumferential direction and is supported.

FIG. 9 is a variant of the combustor which is modified particularly with respect to FIG. 6, according to which two adjustable swirl devices 7, 47 which follow one another in the axial direction are provided on the central body 19. In this case, fingers 5, 48 of an axially displaceable sleeve 4' engage in the apertures 3, 11 of respective annular bodies of the two swirl devices 7, 47. In this case, the sleeve 4' is disposed by means of a section, which is widened downstream in the manner of steps, on a radial shielding wall 12' between the axially spaced apertures 3, 11 in an axially displaceable manner. As described with respect to FIG. 6, upstream, the sleeve 4' is disposed in an axially displaceable manner on the central body 19 (part 21).

On the portion that is widened in a step shape, the sleeve 4' is provided with openings 49 which ensure the corresponding supply of the primary air portion to the apertures 3.

By means of the arrangement according to FIG. 9, the whole primary air P or a significant portion of this primary air can be supplied to the primary zone 14 by way of the two swirl devices 7, 47 as a function of the load as well as for the purpose of a combustion that is as low in pollutants as possible. Despite the variably controllable and adjustable supply of primary air, a pronounced swirl and rotational whirl formation (see also W, W1—FIG. 6) is not impaired.

The embodiments according to FIGS. 6 to 9 are annular combustion chambers, in which case several of the illustrated combustors are always arranged on the head side to be uniformly distributed along the circumference. The invention—as described and illustrated— may analogously also be used advantageously in the case of individual combustion chambers (pipe construction) which each have only one combustor.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A burner having a fuel nozzle (9) for gas turbine engines, comprising:

a ring-shaped swirling device (7) coaxially arranged radially outward and downstream from a longitudinal axis (13) through said fuel nozzle (9), said swirling device (7) having an outer and an inner annular surface;

flow passages (3) equidistantly spaced along a circumference of said ring-shaped swirling device (7) for an adjustable feeding of combustion air, said flow passages (3) extending through said swirling device from the outer to the inner annular surface thereof in a skewed direction with respect to a radial from said longitudinal axis (13) and having same rectangular cross-sections along their entire length;

an annular sleeve member (4) arranged on the outer annular surface of said swirling device (7) so as to be displaceable in a direction of said longitudinal axis (13);

fingers (5) on said annular sleeve member (4) extending from an annular end face thereof and uniformly inclined inwardly into said flow passages and being displaceable in the direction of said longitudinal axis (13) within said flow passages (3);

said fingers (5) being arranged in parallel with respect to first and second internal walls of said flow passages (3) which opposingly face each other in the direction of said longitudinal axis (13) and which limit a maximal adjusting path of said fingers on said sleeve;

wherein in each adjusted position, spaces are formed between said fingers (5) and said second internal walls, said spaces providing constant flow cross-sections for the combustion air inside said flow passages (3) over an entire length thereof.

2. A burner according to claim 1, wherein the flow passages have square cross-sections.

3. A burner according to claim 2, wherein the flow passages are formed at a downstream end of the ring-shaped swirling device.

4. A burner according to claim 2, wherein the ring-shaped swirling device is formed on a downstream front face of a central body which is arranged coaxially with respect to the longitudinal axis.

5. A burner according to claim 2, wherein the burner further includes at least one additional ring-shaped swirling device coaxially arranged radially outward and downstream from the longitudinal axis, said additional swirling device having outer and inner annular surfaces with non-adjustable flow passages extending therethrough, wherein said ring-shaped swirling device and said additional swirling device produce rotational whirls either counter or congruent with each other, and wherein said ring-shaped swirling device and said additional swirling device are shielded with respect to one another in each case via guide sleeves arranged coaxially with respect to the longitudinal axis on the inner annular surface and extending in a radially inward and axially outward direction.

6. A burner according to claim 1, wherein the flow passages are formed at a downstream end of the ring-shaped swirling device.

7. A burner according to claim 6, wherein the ring-shaped swirling device is formed on a downstream front face of a central body which is arranged coaxially with respect to the longitudinal axis.

8. A burner according to claim 6, further comprising first and second additional ring-shaped swirling devices having inner and outer annular surfaces with non-adjustable flow passages extending therethrough, said ring-shaped swirling device being arranged downstream of said first and second additional ring-shaped swirling devices.

9. A burner according to claim 6, wherein the fingers are arranged on the annular end face of the annular sleeve member at a downstream end.

10. A burner according to claim 9, wherein the burner further includes at least one additional ring-shaped swirling device coaxially arranged radially outward and downstream from the longitudinal axis, said additional swirling device having outer and inner annular surfaces with non-adjustable flow passages extending therethrough, wherein said ring-shaped swirling device and said additional swirling device produce rotational whirls either counter or congruent with each other, and wherein said ring-shaped swirling device and said additional swirling device are shielded with respect to one another in each case via guide sleeves arranged coaxially with respect to the longitudinal axis on the inner annular surface and extending in a radially inward and axially outward direction.

11. A burner according to claim 9, further comprising:

a shielding wall for the fuel nozzle, said shielding wall being arranged coaxially with respect to the longitudinal axis, an additional ring-shaped swirling device coaxially arranged with respect to the longitudinal axis downstream from the ring-shaped swirling device, said additional ring-shaped swirling device having outer and inner annular surfaces with non-adjustable flow passages extending therethrough, and further wherein the additional ring-shaped swirling device has a downstream wall portion having an outer rounded surface coaxially arranged with respect to the longitudinal axis and diverging radially outward with respect to the longitudinal axis.

12. A burner according to claim 1, wherein the ring-shaped swirling device is formed on a downstream front face of a central body which is arranged coaxially with respect to the longitudinal axis.

13. A burner according to claim 12, wherein the fingers are arranged on the annular end face of the annular sleeve member at a downstream end.

14. A burner according to claim 12, wherein the burner further includes at least one additional ring-shaped swirling device coaxially arranged radially outward and downstream from the longitudinal axis, said additional swirling device having outer and inner annular surfaces with non-adjustable flow passages extending therethrough, wherein said ring-shaped swirling device and said additional swirling device produce rotational whirls either counter or congruent with each other, and wherein said ring-shaped swirling device and said additional swirling device are shielded with respect to one another in each case via guide sleeves arranged coaxially with respect to the longitudinal axis on the inner annular surface and extending in a radially inward and axially outward direction.

15. A burner according to claim 12, further comprising:

a shielding wall for the fuel nozzle, said shielding wall being arranged coaxially with respect to the longitudinal axis, an additional ring-shaped swirling device coaxially arranged with respect to the longitudinal axis downstream from the ring-shaped swirling device, said additional ring-shaped swirling device having outer and inner annular surfaces with non-adjustable flow passages extending therethrough, and further wherein the additional ring-shaped swirling device has a downstream wall portion having an outer rounded surface coaxially arranged with respect to the longitudinal axis and diverging radially outward with respect to the longitudinal axis.

16. A burner according to claim 12, further comprising first and second additional ring-shaped swirling devices having inner and outer annular surfaces with non-adjustable flow passages extending therethrough, said ring-shaped swirling device being arranged downstream of said first and second additional ring-shaped swirling devices.

17. A burner according to claim 12, wherein a further ring-shaped swirling device coaxially arranged radially outward and downstream from a longitudinal axis through said fuel nozzle is provided, wherein said ring-shaped swirling device and said further ring-shaped swirling device have adjustable flow passages extending therethrough, said ring-shaped swirling device and said further ring-shaped swirling device arranged directly following one another in the downstream direction.

18. A burner according to claim 1, wherein the burner further includes at least one additional ring-shaped swirling device coaxially arranged radially outward and downstream from the longitudinal axis, said additional swirling device having outer and inner annular surfaces with non-adjustable flow passages extending therethrough, wherein said ring-shaped swirling device and said additional swirling device produce rotational whirls either counter or congruent with each other, and wherein said ring-shaped swirling device and said additional swirling device are shielded with respect to one another in each case via guide sleeves arranged coaxially with respect to the longitudinal axis on the inner annular surface and extending in a radially inward and axially outward direction.

19. A burner according to claim 18, further comprising:

a shielding wall for the fuel nozzle, said shielding wall being arranged coaxially with respect to the longitudinal axis, an additional ring-shaped swirling device coaxially arranged with respect to the longitudinal axis downstream from the ring-shaped swirling device, said additional ring-shaped swirling device having outer and inner annular surfaces with non-adjustable flow passages extending therethrough, and further wherein the additional ring-shaped swirling device has a downstream wall portion having an outer rounded surface coaxially arranged with respect to the longitudinal axis and diverging radially outward with respect to the longitudinal axis.

20. A burner according to claim 1, further comprising:

a shielding wall for the fuel nozzle, said shielding wall being arranged coaxially with respect to the longitudinal axis, an additional ring-shaped swirling device coaxially arranged with respect to the longitudinal axis downstream from the ring-shaped swirling device, said additional ring-shaped swirling device having outer and inner annular surfaces with non-adjustable flow passages extending therethrough, and further wherein the additional ring-shaped swirling device has a downstream wall portion having an outer rounded surface coaxially arranged with respect to the longitudinal axis and diverging radially outward with respect to the longitudinal axis.

21. A burner according to claim 1, further comprising first and second additional ring-shaped swirling devices having inner and outer annular surfaces with non-adjustable flow passages extending therethrough, said ring-shaped swirling device being arranged downstream of said first and second additional ring-shaped swirling devices.

* * * * *